US005098141A

United States Patent [19]

Bull

[11] Patent Number: 5,098,141

[45] Date of Patent: Mar. 24, 1992

[54] QUICK RELEASE GLOVE BOX LATCH MECHANISM

[75] Inventor: Kevin A. Bull, Grand Rapids, Mich.

[73] Assignee: Leon Plastics, Inc., Grand Rapids, Mich.

[21] Appl. No.: 754,032

[22] Filed: Sep. 3, 1991

[51] Int. Cl.[5] ..... E05C 5/00

[52] U.S. Cl. ..... 292/252; 70/386

[58] Field of Search ..... 292/252, DIG. 31, 166, 292/193; 70/386; 24/115 L

[56] References Cited

U.S. PATENT DOCUMENTS

| | | | |
|---|---|---|---|
| 2,709,101 | 5/1955 | Dickinson | 202/252 |
| 3,764,172 | 10/1973 | Standke | 292/252 X |
| 3,980,327 | 9/1976 | Duran | 292/252 |
| 4,512,597 | 4/1985 | Nobb et al. | 292/252 |
| 4,893,810 | 1/1990 | Lee | 24/115 L X |
| 4,989,907 | 2/1991 | Edmonds et al. | 292/DIG. 31 X |

*Primary Examiner*—Richard E. Moore

*Attorney, Agent, or Firm*—Varnum, Riddering, Schmidt & Howlett

[57] ABSTRACT

An improved quick release glove box latch mechanism (10) includes a button (76) having at least one undercut (90) which can be disposed in register with one or more fingers (146) of a lever (120) to interlock the lever (120) to the button (76). The button (76) can be integrally molded to form the undercuts (90). An outer collar (270) can be integrally molded to a housing (70) of the latch mechanism (10) and can extend rearwardly from the housing (70). A locking collar (78) is mounted within the outer collar (270). The lever (120) pivots about a pivot pin (122) and is biased to a rest position by a torsion spring (124). A first end (128) of the torsion spring (124) is received in a small bore or slot (160) in the lever (120). A second end (130) of the torsion spring (124) is disposed in a small bore or slot (284) in the housing (70) in such a manner that the pivot pin (122) retains the second end (130) of the torsion spring (124) in the housing (70).

15 Claims, 4 Drawing Sheets

QUICK RELEASE GLOVE BOX LATCH MECHANISM

BACKGROUND OF THE INVENTION

1. Field of the Invention

This invention relates to a quick release latch mechanism for the glove box of an automobile, truck or the like.

2. Description of the Related Art

Quick release locking mechanisms have a wide variety of applications where quick release and secure holding with a moderate amount of force are required. For example, U.S. Pat. No. 4,893,810 to Lee, issued Jan. 16, 1990, relates to a quick release collar for use with a weightlifting barbell. The quick release collar has an inner collar or button and an outer sleeve mounted in telescoping relationship with respect to each other. The button has a grip ring pressed onto one of its ends and has radial openings at its other end. Radially movable steel balls are mounted in the radial openings. The button has an outwardly extending radial flange on its outer surface near the radial openings. The outer sleeve has an inwardly directed radial flange to provide a stop for a coil spring mounted between the flanges of the outer sleeve and the button. A tension ring or collar is press fit into the end of the outer sleeve and is disposed around the button and the radial openings thereof. The tension ring has at an inner end thereof an inclined inner surface portion which permits the balls to move through the radial openings of the button only when the spring is compressed. Thus, when the spring is compressed, the balls move through the radial openings, and the barbell can be freely moved with respect to the quick release collar.

A quick release locking mechanism has been proposed for use to latch a glove box door in an automobile. This latch mechanism is used in combination with a stud which is mounted to the frame of the glove box. The stud receives the latch mechanism which is mounted onto the glove box door. A lever is pivotally mounted on the door to operate the latch mechanism.

The latch mechanism comprises a hollow, cylindrical button having at a first end thereof three radial openings adapted to receive radially movable metal balls. The button includes a cylindrical outer surface and an annular grip ring at a second end to retain an end of the lever actuator. The annular grip ring is separately manufactured and then pressed onto the second end of the button. The button includes an outwardly extending radial flange which is provided near the radial openings and inwardly thereof as a spring stop. An outer sleeve has an inwardly extending radial flange which forms a spring retainer with the outwardly extending radial flange of the button. A spring is provided between the flanges of the button and the outer sleeve so that the outer sleeve is biased toward the second end of the button.

A tension ring or collar is mounted inside the outer sleeve in proximity to the radial openings of the button. The tension ring has at an inner end thereof an inclined inner surface portion which permits the balls to move through the radial openings of the button only when the spring is compressed. In other words, when the button is moved axially with respect to the outer sleeve in a direction so that the outer sleeve moves away from the first end of the button, the balls are released from contact with the shaft so that the shaft can freely slide within the button. Conversely, movement of the outer sleeve toward the first end of the button extends the spring and drives the tension ring over the balls to force the balls into the radial openings. When a shaft is positioned within the button, the balls will frictionally engage the shaft to lock the button onto the shaft.

The button, the outer sleeve and the spring are constructed so that the balls are normally biased into contact with the shaft. Thus, pulling the button with respect to the outer sleeve to disengage the balls will allow the button to slide along the shaft. Release of the pulling motion then automatically locks the balls onto the shaft in a desired position.

The lever has a handle for gripping by the fingers of a user and is pivotally mounted on pivot pins within an opening in the latch mechanism housing. The lever has a pair of fingers which are adapted to pull the annular grip ring of the button to actuate movement of the button. The outer sleeve is assembled with the housing in a fixed manner so that when the lever is rotated, the button moves with respect to the outer sleeve and thus disengages any gripping of the balls on the shaft.

The aforementioned quick release glove box latch mechanism is somewhat difficult to manufacture and assemble and not particularly cost efficient to produce. Further, the glove box actuator lever or handle of the previous latch may rattle during operation of the automobile.

SUMMARY OF THE INVENTION

The invention relates to improvements in a glove box latch mechanism which includes a striker pin adapted to be mounted to the glove box, and a latch assembly adapted to be mounted to a door of the glove box. The latch assembly includes a housing having a front end and a rear end, a cylindrical opening extending therethrough, a lever pivotally mounted to the housing, and a tubular button mounted in the cylindrical opening for axial movement between a rear and a forward position. The striker pin can be slidably received in the tubular button. The tubular button includes radial openings which receive radially movable balls for engaging and locking the striker pin in the tubular button. The latch assembly also includes at least one finger mounted on the lever which interfaces with the button to pull the button toward the front end of the housing as the lever pivots between a rest and a release position. A spring biases the button toward the rear position. The glove box latch also includes a locking collar mounted to the housing in such a manner that the collar is disposed between the housing and the button. The locking collar is concentric with respect to the button and has a ramp for urging the radially movable balls inwardly for contact with the striker pin when the button is in the rear position.

In one of its aspects, the invention relates to an improvement in the above-described glove box latch wherein at least one undercut is provided on the button in register with the finger of the lever to interlock the lever to the button. If desired, two undercuts can be provided on opposite sides of the button. Preferably, the button is integrally molded to form the undercuts.

In another of its aspects, the invention relates to an improvement in the above-described glove box latch wherein an outer collar is integrally molded to the housing and extends rearwardly from the housing. The locking collar is mounted in the outer collar. Preferably, this glove box latch also includes a lateral chamber extending through the housing and in spaced relation to the outer collar. A locking bar is slidably mounted in the chamber for movement between locking and unlocking positions, and the locking bar includes a locking projection. When the locking bar is in the locked position, the projection formed on the locking bar interfaces with the finger of the lever to prevent pivotal movement of the lever between the rest and the release position.

A mechanism as described above can have a lever which is pivotally mounted to the housing by a lever pin. A torsion spring is mounted on the lever pin wherein one end of the torsion spring is anchored to the lever and the other end of the torsion spring is anchored to the housing. In one of its aspects, the invention relates to an improvement of this mechanism wherein a slot is provided in the housing to receive the other end of the torsion spring, and the lever pin retains this end of the torsion spring in the housing. Preferably, the lever pin includes a head and the opening in the side wall of the housing is adapted to receive the head of the lever pin. In addition, the lever preferably has a lateral opening for receiving the one end of the torsion spring.

BRIEF DESCRIPTION OF THE DRAWINGS

The invention will now be described with reference to the drawings in which.

DETAILED DESCRIPTION OF THE PREFERRED EMBODIMENTS

Figure 1:
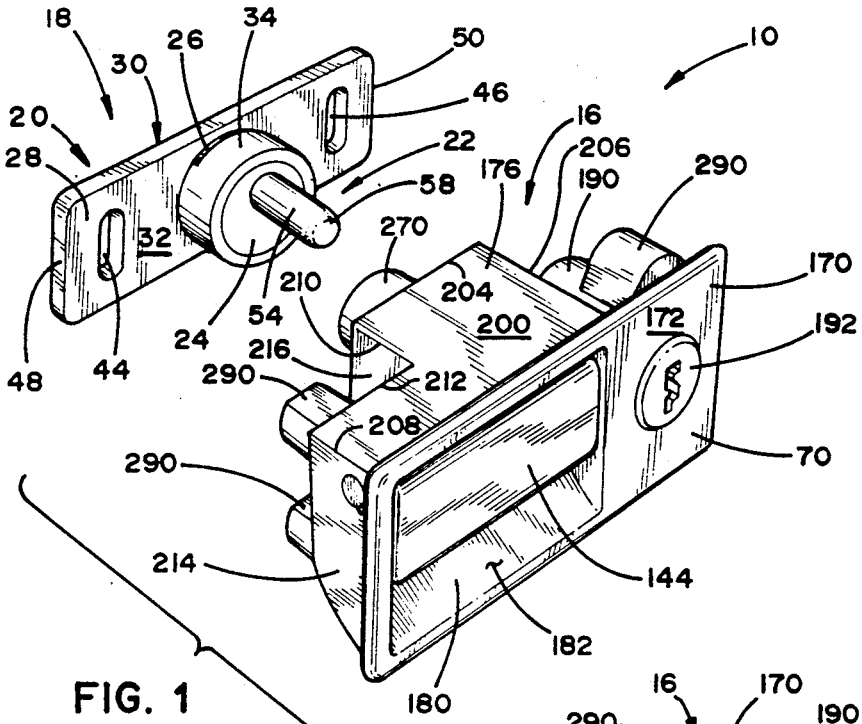
FIG. 1 is a front perspective view of a quick release glove box latch mechanism, showing in solid lines a first (at rest) position of a handle for the latch mechanism and showing in phantom lines a second (release) position of the handle.
Figure 2:
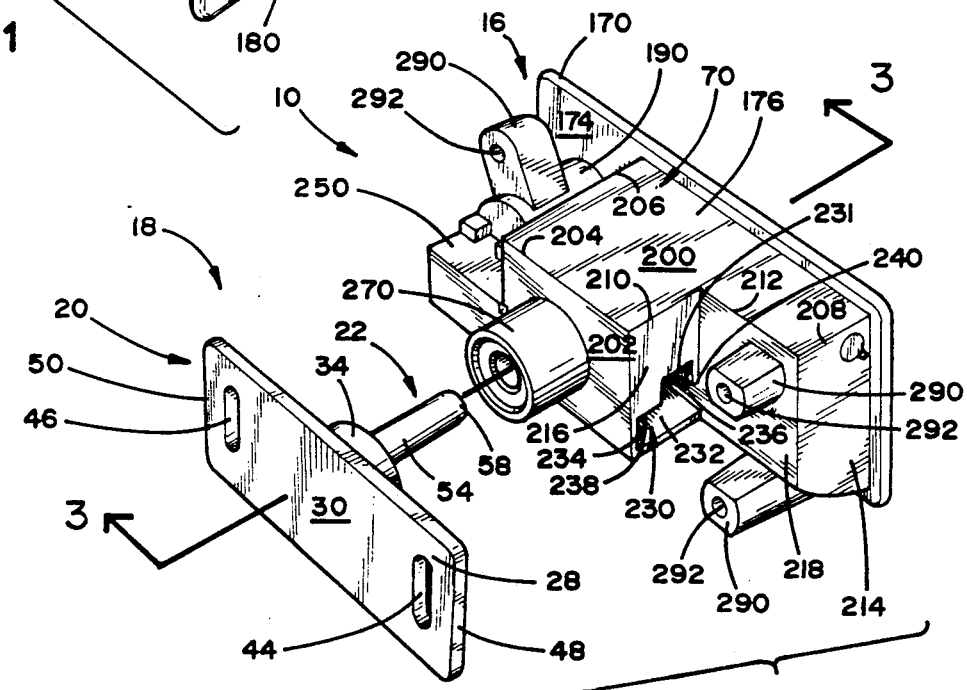
FIG. 2 is a rear perspective view of the latch mechanism.

Referring now to FIGS. 1 and 2, a glove box latch mechanism 10 is used for latching (opening and closing) a door of a glove box. The glove box latch mechanism 10 comprises two assemblies: a housing assembly 16 and a striker pin assembly 18.

Figure 6:
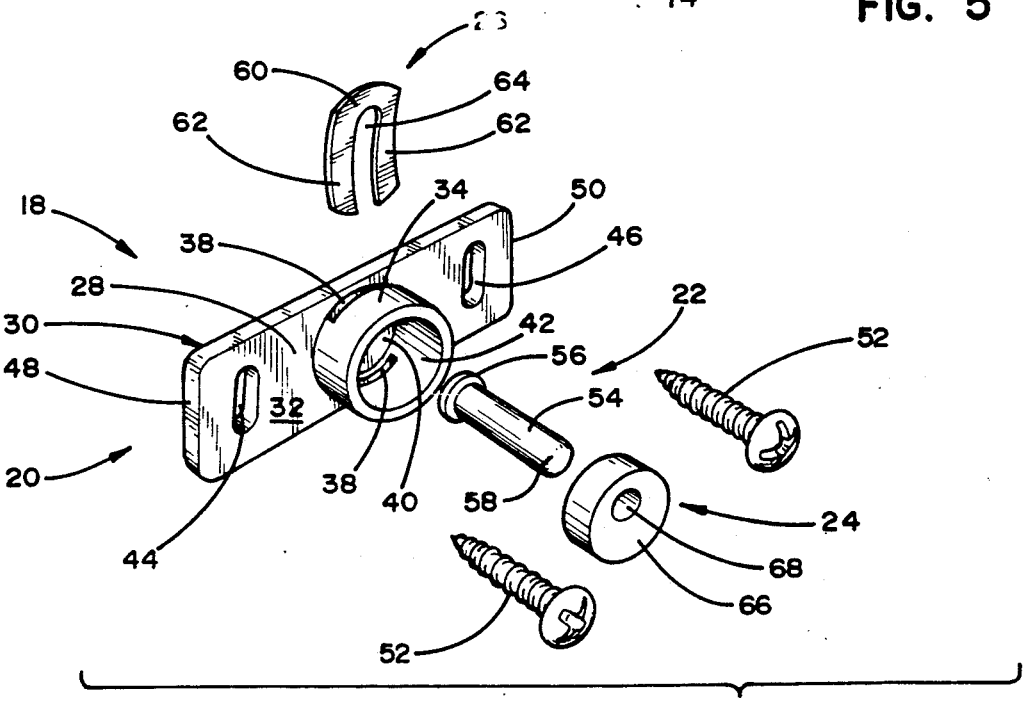
FIG. 6 is an exploded view of the striker pin assembly.

Turning to FIG. 6, the striker pin assembly 18 comprises a striker plate 20, a striker pin 22, a pin stabilizer 24 and a spring clip 26. The striker plate 20 is preferably formed of a thermoplastic material such as ABS, and accordingly, can be injection molded. The striker plate 20 comprises a rectangular plate 28 having a bottom side 30 and a top side 32. The striker plate 20 further includes a cylinder 34 centrally disposed on the rectangular plate 28 and extending from the top side 32 thereof. Preferably, the cylinder 34 is integral with the rectangular plate 28.

Figure 3:
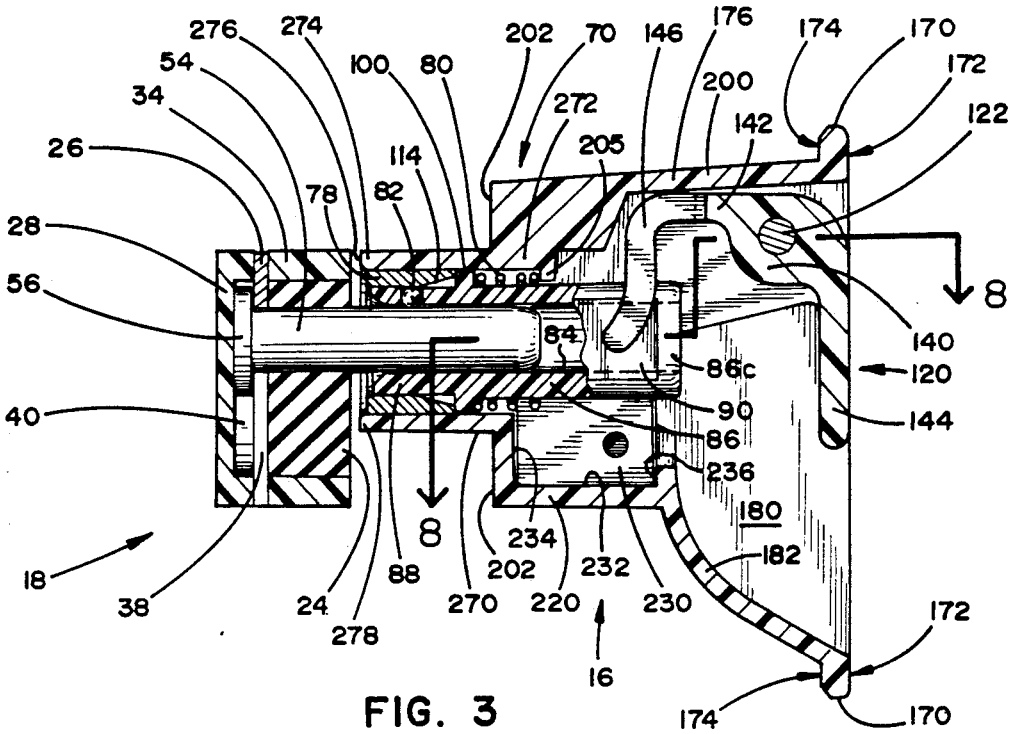
FIG. 3 is a vertical sectional view taken along the lines 3—3 of FIG. 2, with some features shown as they would appear in a side view, and showing the latch handle in the at rest position.

As best shown in FIGS. 3 and 6, two relatively thin slots 38 extend transversely through the walls of the cylinder 34. As shown in FIG. 6, the slots 38 permit the spring clip 26 to be inserted through the cylinder 34 as described further below. A first hollow area 40 is provided inside the cylinder 34 and disposed between the rectangular plate 28 and the slots 38. A second hollow area 42 is provided inside the cylinder 34 and is disposed on the other side of the slots 38.

Elongated slots 44, 46 extend through the rectangular plate 28 at positions between the cylinder 34 and respective ends 48, 50 of the rectangular plate 28. Fasteners 52 extend through the elongated slots 44, 46 for purposes of fastening the rectangular plate 28 to a stationary frame of the glove box.

The striker pin 22 is preferably made of metal such as cold rolled steel and includes a shank 54 and an integral head 56. The shank 54 preferably has a rounded end 58 disposed opposite from the head 56. As best shown in FIG. 3, the head 56 is adapted to be disposed in the first hollow area 40 of the cylinder 34 and securely held between the spring clip 26 and the rectangular plate 28.

Referring again to FIG. 6, the spring clip 26 has a U-shape formed by a body portion 60 and depending legs 62. The body portion 60 and the depending legs 62 define a central elongated slot 64 which is adapted to receive the shank 54 of the striker pin 22. The spring clip 26 is preferably made of a metal such as 1064 spring steel. Also, the spring clip 26 is preferably about 1 millimeter (mm) thick and has a symmetrical arc of curvature (a radius of curvature of about 49 mm is preferred).

The pin stabilizer 24 includes a cylindrical body 66 and a hole 68 extending through the cylindrical body 66 at a position which is offset from the geometric center of the cylindrical body 66. The pin stabilizer 24 firmly, but flexibly, holds the shank 54 of the striker pin 22. Preferably, the pin stabilizer 24 comprises rubber such as 20–30 durometer rubber. The pin stabilizer 24 is adapted to be disposed and firmly retained in the second hollow area 42 of the cylinder 34.

The striker pin assembly 18 is preferably made by injection molding the striker plate 20 in such a manner that the cylinder 34 is integrally formed with the rectangular plate 28. The shank 54 of the striker pin 22 is then inserted into the hole 68 of the pin stabilizer 24. The head 56 of the striker pin 22 is then inserted into the cylinder 34 of the striker plate 20. The head 56 should be disposed adjacent the rectangular plate 28 in the first hollow area 40 of the cylinder 34. Next, the spring clip 26 is inserted through the slots 38 of the cylinder 34 so that the central elongated slot 64 of the spring clip 26 loosely receives the shank 54 of the striker pin 22, and the pin stabilizer 24 should be disposed in the second hollow area 42 of the cylinder 34. The shank 54 of the striker pin 22 extends through the hole 68 of the pin stabilizer 24. The depending legs 62 of the spring clip 26 will then be disposed between the head 56 of the striker pin 22 and the cylindrical body 66 of the pin stabilizer 24. The striker pin assembly 18 can then be mounted to the stationary frame of the glove box as described above.

Figure 5:
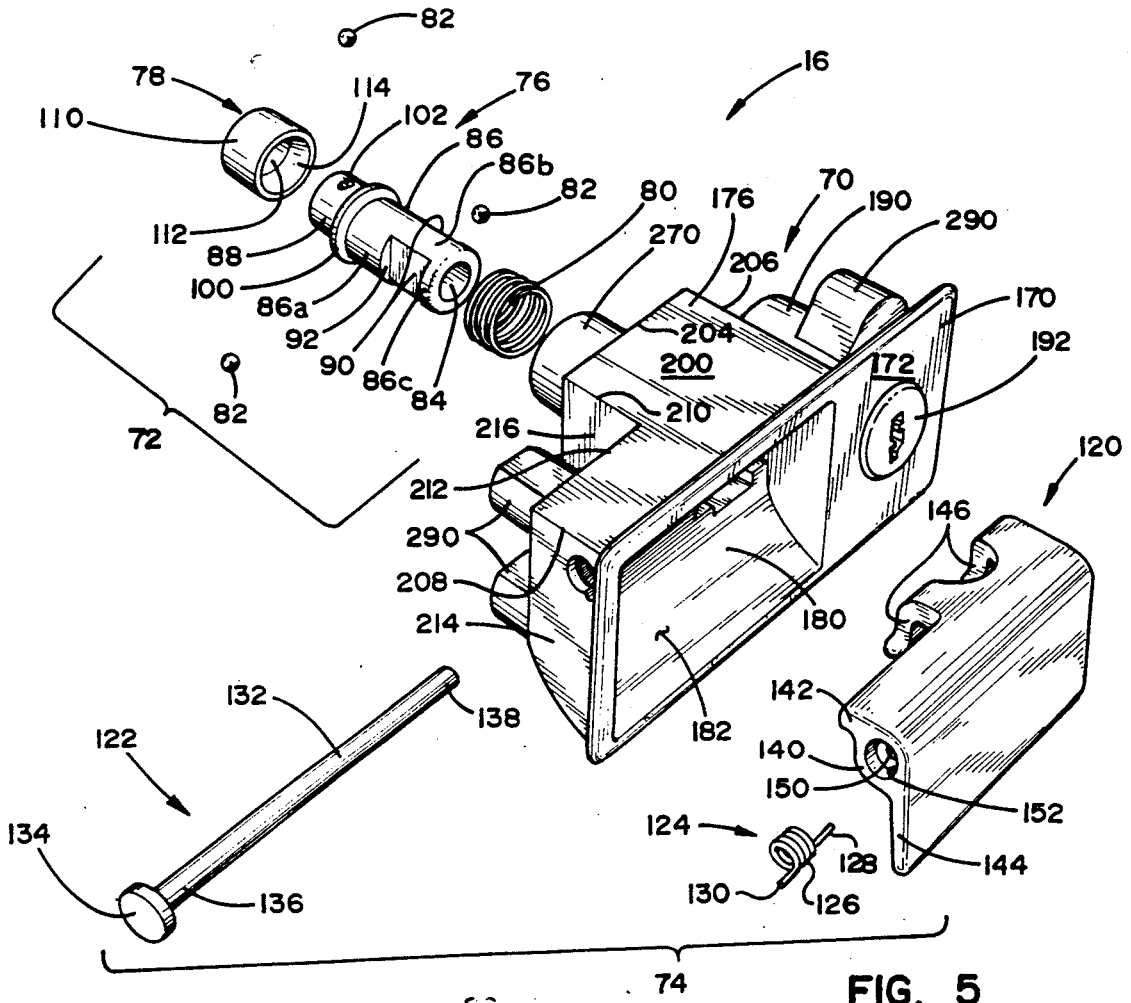
FIG. 5 is similar to FIG. 1 but is an exploded view and the striker pin assembly is not shown.

Referring to FIGS. 1 and 2, the glove box latch mechanism 10 also comprises a housing assembly 16. As best shown in FIG. 5, the housing assembly 16 includes a housing 70, a button subassembly 72, and a latch handle subassembly 74.

The button subassembly 72 includes a button 76, a collar 78, a spring 80 and three spherical balls 82. The button 76 is preferably formed of a thermoplastic material such as ABS, and accordingly, can be injection molded. The button 76 includes annular inner side walls 84 which define a hole extending through the button 76. The annular inner side walls 84 are adapted to receive the shank 54 of the striker pin 22 (FIG. 3). The button 76 includes a first cylindrical outer surface 86 and a second cylindrical outer surface 88 of smaller diameter. As can be seen, the first cylindrical outer surface 86 is discontinuous and comprises a first segment 86*a*, a second segment 86*b* and a third segment 86*c*. Although the segments 86*a* and 86*c* are continuously cylindrical, the segment 86*b* is not. The button 76 includes two undercuts 90 which are disposed on opposite sides of the button 76 in the same longitudinal location as the second segment 86*b* of the first cylindrical outer surface 86.

The button 76 is formed with an outwardly extending radial flange 100 which separates the first cylindrical outer surface 86 from the second cylindrical outer surface 88. The button 76 in the longitudinal location of the second cylindrical outer surface 88 includes radial openings 102 which extend from the annular inner side walls 84 to the second cylindrical outer surface 88. Preferably, there are three radial openings 102 which are disposed 120 degrees apart from each other around the periphery of the button 76. The spherical balls 82, which are preferably made of metal, are adapted to be disposed in the radial openings 102. The radial openings 102 are tapered or otherwise shaped to permit the balls 82 to move radially inwardly and outwardly but not to pass through the openings 102 in the radially inward direction.

The collar 78 comprises a cylinder having a continuous outer surface 110 and an inner surface formed by continuous inner side walls 112 and tapered inner side walls 114. The collar 78 can be slidably received over the second cylindrical outer surface 88 of the button 76. The tapered inner side walls 114 of the collar 78 should be disposed closer to the outwardly extending radial flange 100 (of the button 76) than the continuous inner side walls 112. Preferably, the outer surface 110 of the collar 78 is rough and not smooth to aid in gripping of the outer surface 110. Preferably, the collar 78 is formed of metal such as 52100 steel or 52200 steel (cold rolled steel).

The button subassembly 72 is formed by injection molding the button 76. The spherical balls 82 can then be inserted into the radial openings 102. Next, the collar 78 can be fitted around the button 76 in the manner described above. The spring 80 is then fitted around the other end of the button 76 so that it surrounds and bears against the first segment 86*a* of the first cylindrical outer surface 86.

With continuing reference to FIG. 5, the housing assembly 16 also includes the latch handle subassembly 74. The latch handle subassembly 74 includes a latch handle 120, a handle pivot pin 122 and a torsion spring 124. Preferably, the latch handle is made of a thermoplastic material such as ABS, and accordingly, can be injection molded. The handle pivot pin 122 is preferably made of metal such as cold rolled steel.

The torsion spring 124 includes coils 126 and prongs 128, 130 extending from opposing ends thereof. The handle pivot pin 122 includes a shank 132 and a head 134 which is integral with a first end 136 of the shank 132. The torsion spring 124 and the handle pivot pin 122 are sized in such a manner that the torsion spring 124 can be slidably received on the shank 132 of the handle pivot pin 122.

As shown in FIGS. 3 and 5, the latch handle 120 includes a generally cylindrical body 140, a flange 142 which is integral with the cylindrical body 140, and a grasping flange 144 which is also integral with the cylindrical body 140 and extends therefrom at an angle which is offset ninety degrees from the flange 142. Retaining fingers 146 are integral with the flange 142 and extend downwardly in generally the same direction as the grasping flange 144. The retaining fingers 146 are adapted to grasp or bear against the third segment 86*c* of the first cylindrical outer surface 86 of the button 76. Thus, the retaining fingers 146 grasp the button 76 in the area of the undercuts 90.

Figure 8:
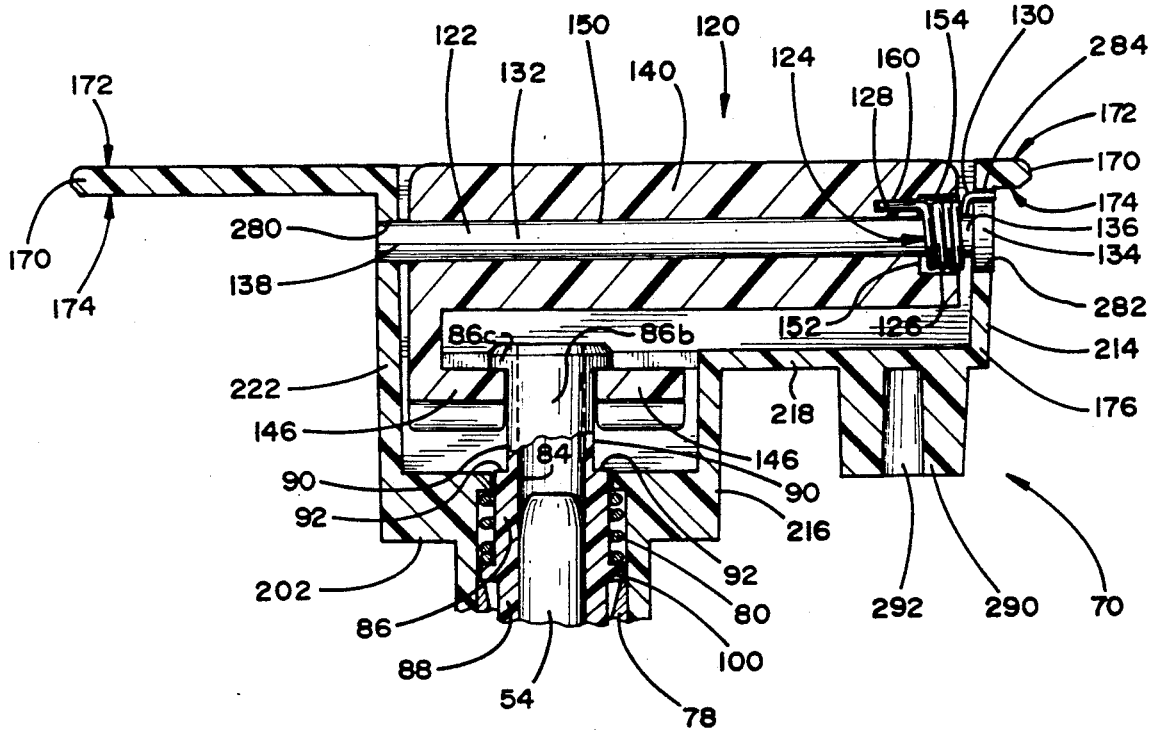
FIG. 8 a horizontal sectional view taken along the lines 8—8 of FIG. 3.

As best shown in FIG. 8, the generally cylindrical body 140 of the latch handle 120 includes an elongated, counterbored hole 150 extending therethrough which is adapted to receive the handle pivot pin 122. Because the generally cylindrical body 140 is provided with a counterbored hole 150, a shoulder 152 and a cylindrical recess 154 are thereby formed which cooperate to serve as a seat for the coils 126 of the torsion spring 124. A small bore 160 extends inwardly of the latch handle 120 from the shoulder 152. The small bore 160 receives the prong 128 of the torsion spring 124. The torsion spring 124 biases the latch handle 120 to a first (at rest) position.

Turning now to FIGS. 1, 2 and 5, the housing assembly 16 also includes the housing 70. The housing 70 is preferably made of a thermoplastic material such as ABS, and accordingly, can be injection molded. The housing 70 includes a face plate 170 having a front surface 172 and a rear surface 74. A block 176 extends rearwardly from the rear surface 174 of the face plate 170. The block 176 and the face plate 170 are integral and cooperate to form a recess 180 delimited by a sloping panel 182 extending upwardly and rearwardly from a lower portion of the face plate 170.

Integrally formed with the face plate 170 and extending rearwardly from the rear surface 174 thereof is a housing 190 for a cylinder lock 192, the structure of which is well known to those having ordinary skill in the art of latch mechanisms. The cylinder lock 192 includes a rotatable cylinder (not shown) which is actuated by insertion of a key having the correct serrations thereon. When the correct key is inserted, the cylinder inside the cylinder lock rotates, thereby also rotating a single pin extending rearwardly from the rear end of the cylinder. This cylinder pin is adapted to move a locking bar 194, the structure of which is defined in further detail below, to a locked position or an unlocked position.

Referring to FIG. 2, the block 176 includes a top panel 200 and a rear panel 202 depending downwardly from a rear edge 204 of the top panel 200. The top panel 200 also includes a right side edge 206, a first left side edge 208, a second left side edge 210, and an intermediate edge 212 extending from the first left side edge 208 to the second left side edge 210.

Figure 4:
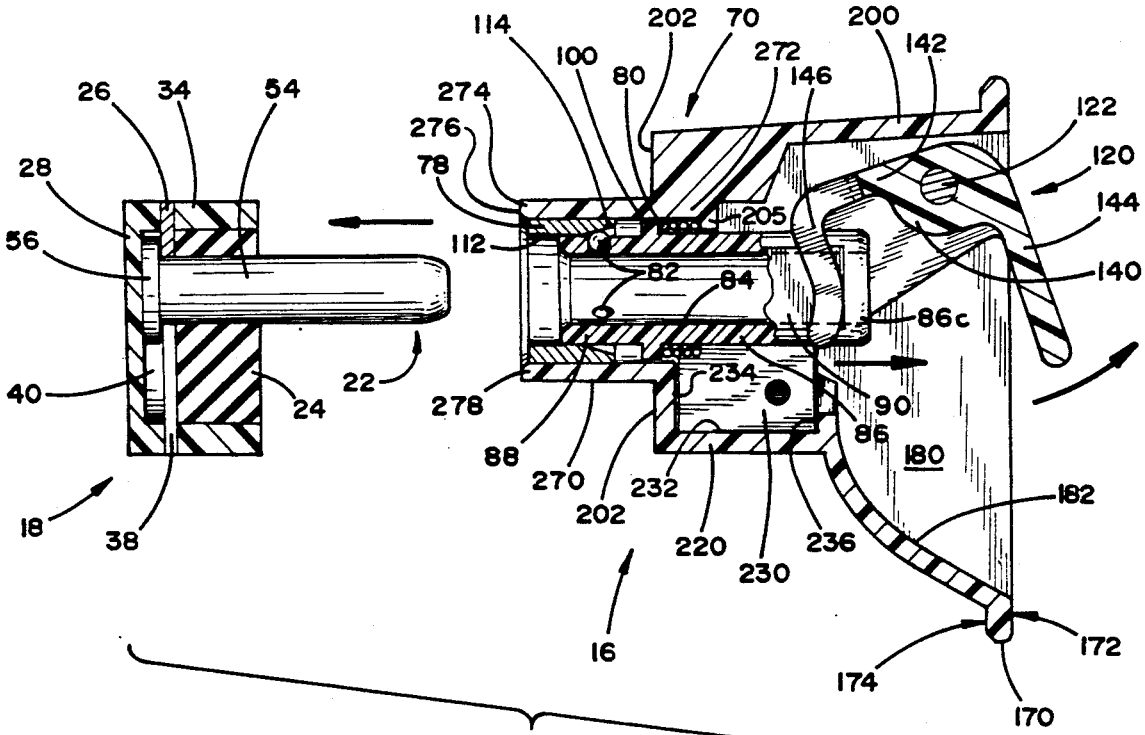
FIG. 4 is the same as FIG. 3 but showing the latch handle in the release position and showing a striker pin assembly which has been released from the remainder of the latch mechanism.

A first left side panel 214 extends downwardly from the first left side edge 208 and is integral with the gear surface 174 of the face plate 170. A second left side panel 216 extends downwardly from the second left side edge 210 and extends forwardly from the rear panel 202 of the block 176. An intermediate panel extends downwardly from the intermediate edge 212 and extends from the first left side panel 214 to the second left side panel 216. As shown in FIGS. 3 and 4, a bottom panel 220 extends forwardly from a lower edge of the rear panel 202 to an integral connection with the sloping panel 182. As can be seen in FIG. 8, the block 176 includes a right side panel 222 which depends downwardly from the right side edge 206 (FIG. 5).

Referring to FIG. 2, a large cutout portion 230 and a small cutout portion 231 are provided in the block 176. The cutout portions 230, 231 cooperate to receive the locking bar 194. The large cutout portion 230 is defined by a bottom wall 232, a left side wall 234 and a right side wall 236 extending upwardly from the bottom wall 232, and intermediate top walls 238, 240 extending inward of the cutout portion 230 from the left side wall 234 and the right side wall 236, respectively. The small cutout portion 231 is disposed above the large cutout portion 230, has a similar rectangular shape as the large cutout portion 230, but is smaller than the large cutout portion 230.

As shown in FIG. 2, a cylinder block 250 is disposed rearwardly of the cylinder lock housing 190. The cylinder block 250 is integrally formed with the block 176. Referring to FIGS. 2–4, the bottom wall 232, a portion of the left side wall 234, and a portion of the right side wall 236 extend through the block 176 and into the cylinder block 250, terminating just short of the end of the cylinder block 250 which is opposite from the block 176.

As shown in FIGS. 3 and 4, the block 176 includes an outer collar 270 which is integral with the rear panel 202 and extends rearwardly therefrom. The outer collar 270 includes a front end 272, a rear end 274, an upper cylindrical portion 276 and a lower cylindrical portion 278. At the front end 272 of the outer collar 270, an undercut is provided in the lower cylindrical portion 278. In other words, the lower cylindrical portion 278 is shorter than the upper cylindrical portion 276 and integral with the left side wall 234 of the large cutout portion 230.

The undercut in the lower cylindrical portion 278 permits the locking bar 194 to be slid through the block 176 and into the cylinder block 250. After the locking bar 194 has been positioned inside the cylinder block 250, the button subassembly 72 can be inserted through the outer collar 270 as described in further detail below.

The outer collar 270 also includes at the front end 272 thereof an inwardly directed radial flange 205 extending along the upper cylindrical portion 276. The flange 205 acts as a stop for the spring 80 as will be described in further detail below.

Figure 7:
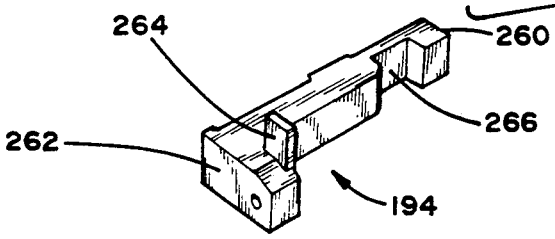
FIG. 7 is a perspective view of a locking bar which forms part of the latch mechanism.

The housing 70 includes the locking bar 194 which is shown separately in FIG. 7. Preferably, the locking bar 194 is made of a thermoplastic material such as ABS, and accordingly, can be injection molded. The locking bar 194 includes a first end 260, a second end 262 and an upwardly extending locking projection 264 disposed near the second end 262. The locking bar 194 also includes a cutout portion 266 which interfaces with the rearwardly extending pin of the cylinder lock.

The pin of the cylinder lock can move the locking bar 194 to the left to a locked position wherein the locking projection 264 bears against one of the fingers 146 of the latch handle 120 to prevent pivotal movement of the latch handle 120 between the rest position and a second (release) position. This in turn prevents a separation of the striker pin assembly 18 from the housing assembly 16.

The pin of the cylinder lock can also cause the locking bar 194 to move to the right to an unlocked position wherein the locking projection 264 does not restrict movement of the latch handle 120. In this unlocked position, the latch handle 120 can be actuated to cause a separation of the striker pin assembly 18 from the housing assembly 16 as will be described in further detail below.

The housing assembly 16 is made by injection molding the housing 70 (note, however, that the locking bar 194 is separately injection molded and then assembled with the remainder of the housing 70), the button 76 and the latch handle 120. Next, the first end 260 of the locking bar 194 can be inserted into the large cutout portion 230 of the block 176. The locking bar 194 should be slid through the block 176 and into the cylinder block 250 to a point where the cutout portion 266 of the locking bar 194 is in open communication with the housing 190 for the cylinder lock. The rotatable cylinder of the cylinder lock can then be inserted into the housing 190 so that the rearwardly extending pin of the rotatable cylinder bears against the cutout portion 266 of the locking bar 194.

Next, the button subassembly 72 (already assembled as discussed above) is inserted into the outer collar 270 until the end of the collar 78 of the button subassembly 72 is generally flush or aligned with the end of the outer collar 270. The collar 78 should preferably be formed such that it can be press fit into the outer collar 270. Because the outer surface of the collar 78 is rough, it can be easily gripped by the outer collar 270. As shown in FIG. 3, the latch handle 120 is then inserted into the recess 180 delimited by the sloping panel 182. Next, the retaining fingers 146 of the latch handle 120 are positioned around the button 76 in the area of the undercuts 90, as best shown in FIGS. 3 and 4.

Then, with reference to FIG. 8, the torsion spring 124 is inserted through a bore 282 disposed in the first left side panel 214 of the block 176 and then into the cylindrical recess 154 formed in the latch handle 120. The prong 128 of the torsion spring 124 is then inserted into the small bore 160 which extends inwardly of the latch handle 120 from the shoulder 152.

The second end 138 of the handle pivot pin 122 can be inserted through the bore 282, through the coils 126 of the torsion spring 124, into the counterbored hole 150 of the latch handle 120, and then through a bore 280 disposed in the right side panel 222 of the block 176. The other prong 130 of the torsion spring 124 is then inserted into a small bore 284 extending through the first left side panel 214 adjacent the bore 282. The handle pivot pin 122 can then be pushed further into the latch handle 120 until the head 134 is received in the bore 282. The head 134 of the handle pivot pin 122 maintains the torsion spring 124 in position and prevents a dislodging of the prong 130 from the small bore 284.

Once the housing assembly 16 has been assembled, it can be mounted to the glove box door. As shown best in FIG. 2, bosses 290 can be provided on the housing 70. Each of the bosses 290 includes an aperture 292 which is adapted to receive a fastener (not shown). The fasteners extend in a suitable manner from the glove box door to the apertures 292 of the bosses 290 to connect the housing assembly 16 to the glove box door. Preferably, the apertures 292 are threaded, and the fasteners comprise screws.

The operation of the glove box latch mechanism 10 is best shown in FIGS. 3 and 4. The striker pin assembly 18 can be mounted to the stationary frame of the glove box and includes the striker pin 22 which slides in and out of the annular inner side walls 84 of the button subassembly 72 of the housing assembly 16. The housing assembly 16 is mounted onto the glove box door in a suitable manner. Preferably, the mounting is such that the face plate 170 of the housing 70 is generally flush with the outer surface of the glove box door.

The latch handle 120 is pivotally mounted on the housing 70 and can be moved to and between the first (at rest) position and the second (release) position. If the grasping flange 144 of the latch handle 120 is grasped and moved in a counterclockwise direction as shown in FIG. 4, the striker pin 22 of the striker pin assembly 18 becomes freely slidable within the annular inner side walls 84 of the button subassembly 72. Hence, the housing assembly 16 will then be freely movable with respect to the striker pin assembly 18, and the glove box door can be moved with respect to the glove box frame for gaining access to the contents of the glove box.

The spring 80 of the button subassembly 72 is disposed between the outwardly extending radial flange 100 of the button 76 and the inwardly directed radial flange 205 of the housing 70. Thus, the spring 80 biases the button 76 away from the forward end or face plate 170 of the housing 70 in a first (at rest) position which coincides with the first (at rest) position of the latch handle 120. As shown in FIG. 3, in the first position, the striker pin assembly 18 can be securely engaged with the housing assembly 16. In other words, when the striker pin 22 is positioned within the annular inner side walls 84 of the button 76, the spherical balls 82 frictionally engage the striker pin 22 to lock the button 76 onto the striker pin 22. The balls 82 are normally biased into contact with the striker pin 22 because of the spring 80.

As shown in FIG. 4, when the latch handle 120 is pulled in the counterclockwise direction, the retaining fingers 146 of the latch handle 120 engage the segment 86*c* of the button 76 and cause the outwardly extending radial flange 100 of the button 76 to compress the spring 80 against the inwardly directed radial flange 205 of the housing 70. When this forward movement of the button 76 occurs, the spherical balls 82 are released from contact with the striker pin 22 because the collar 78 has the tapered inner side walls 114 at the forward end thereof which permit the spherical balls 82 to move radially outwardly through the radial openings 102 of the button 76. The spherical balls 82 are released from contact with the striker pin 22 so that the striker pin 22 can freely slide within the button 76.

Release of the latch handle 120 causes the button 76 to move away from the face plate 170 of the housing 70 and into the position shown in FIG. 3 because of the biasing action of the spring 80. In other words, this movement of the button 76 away from the face plate 170 extends the spring 80 and drives the continuous inner side walls 112 of the collar 78 over the spherical balls 82 to force the balls 82 radially inwardly into the radial openings 102. Accordingly, release of the latch handle 120 automatically locks the spherical balls 82 onto the striker pin 22 in any desired position. The striker pin 22 can be inserted into the button 76 before or after release of the latch handle 120.

The glove box latch mechanism 10 is advantageous because the segment 86*b*, the segment 86*c*, and the undercuts 90 of the button 76 can be integrally formed in an injection molding process. Secondly, the outer collar 270 is integrally formed with the housing 70 in an injection molding process instead of being separately manufactured and then assembled. Thirdly, the outer collar 270 includes the undercut in its lower cylindrical portion 278 at its front end 272. The undercut permits the locking bar 194 to be slid into and suitably positioned within the cylinder block 250. In addition, the torsion spring 124 is provided to bias the latch handle 120 in the at rest position. Thus, the torsion spring 124 prevents any rattling of the latch handle 120 during operation of the automobile.

Reasonable variation and modification are possible within the scope of the foregoing specification and drawings without departing from the spirit of the invention.

The embodiments for which an exclusive property or privilege is claimed are defined as follows:

1. In a latch for a glove box, wherein the latch comprises:
   (a) a striker pin adapted to be mounted to the glove box;
   (b) a latch assembly adapted to be mounted to a door of the glove box, the latch assembly comprising
      (i) a housing with front and rear ends and a cylindrical opening extending therethrough;
      (ii) a lever pivotally mounted to the front end of the housing;
      (iii) a tubular button mounted in the cylindrical opening of the housing for axial movement between a rear and a forward position, wherein the striker pin is slidably received in the tubular button, radial openings are provided in the tubular button, and radially movable balls are disposed in the radial openings and are adapted to engage and lock the striker pin in the tubular button;
      (iv) a finger mounted on the lever which interfaces with the button to pull the button toward the front end of the housing as the lever pivots between a rest and a release position;
      (v) a spring biasing the button toward the rear position;
   (c) a locking collar mounted to the housing and disposed between the housing and the button, the locking collar being concentric with the button and having a ramp for urging the radially movable balls inwardly for contact with the striker pin when the button is in the rear position; the improvement comprising:
   at least one undercut provided on the button in register with the finger of the lever to interlock the lever to the button.

2. A glove box latch according to claim 1 wherein two undercuts are provided on opposite sides of the button.

3. A glove box latch according to claim 2 wherein the button is integrally molded to form the undercuts.

4. In a latch for a glove box, wherein the latch comprises:
   (a) a striker pin adapted to be mounted to the glove box;
   (b) a latch assembly adapted to be mounted to a door of the glove box, the latch assembly comprising
      (i) a housing with front and rear ends and a cylindrical opening extending therethrough;
      (ii) a lever pivotally mounted to the front end of the housing;
      (iii) a tubular button mounted in the cylindrical opening of the housing for axial movement between a rear and a forward position, wherein the striker pin is slidably received in the tubular button, radial openings are provided in the tubular button, and radially movable balls are disposed in the radial openings and are adapted to engage and lock the striker pin in the tubular button;

(iv) a finger mounted on the lever which interfaces with the button to pull the button toward the front end of the housing as the lever pivots between a rest and a release position;

(v) a spring biasing the button toward the rear position;

(c) a locking collar mounted to the housing and disposed between the housing and the button, the locking collar being concentric with the button and having a ramp for urging the radially movable balls inwardly for contact with the striker pin when the button is in the rear position; the improvement comprising:

an outer collar integrally molded to the housing and extending rearwardly from the housing, wherein the locking collar is mounted in the outer collar.

5. A glove box latch according to claim 4 wherein the housing further comprises a lateral chamber in spaced relation to the outer collar and a locking bar slidably mounted in the chamber for movement between locking and unlocking positions, wherein the locking bar includes a projection which interfaces with the finger of the lever when the locking bar is in the locked position to prevent pivoting of the lever between the rest and the release position.

6. A glove box latch according to claim 4 wherein at least one undercut is provided on the button in register with the finger of the lever to interlock the lever to the button.

7. A glove box latch according to claim 6 wherein two undercuts are provided on opposite sides of the button.

8. A glove box latch according to claim 7 wherein the button is integrally molded to form the undercuts.

9. In a latch for a glove box, wherein the latch comprises:

(a) a striker pin adapted to be mounted to the glove box;

(b) a latch assembly adapted to be mounted to a door of the glove box, the latch assembly comprising (i) a housing with front and rear ends, a cylindrical opening extending therethrough, a side wall, and an opening in the side wall;

(ii) a lever pivotally mounted to the front end of the housing by a lever pin, wherein the opening in the side wall of the housing receives the lever pin, a torsion spring is mounted on the lever pin, and one end of the torsion spring is anchored to the lever and the other end of the torsion spring is anchored to the housing;

(iii) a tubular button mounted in the cylindrical opening of the housing for axial movement between a rear and a forward position, wherein the striker pin is slidably received in the tubular button, radial openings are provided in the tubular button, and radially movable balls are disposed in the radial openings and are adapted to engage and lock the striker pin in the tubular button;

(iv) a finger mounted on the lever which interfaces with the button to pull the button toward the front end of the housing as the lever pivots about the lever pin between a rest and a release position;

(v) a spring biasing the button toward the rear position;

(c) a locking collar mounted to the housing and disposed between the housing and the button, the locking collar being concentric with the button and having a ramp for urging the radially movable balls inwardly for contact with the striker pin when the button is in the rear position; the improvement comprising:

a slot provided in the housing to receive the torsion spring other end, wherein the lever pin retains the torsion spring other end in the housing.

10. A glove box latch according to claim 9 wherein the lever pin includes a head and the opening in the side wall of the housing receives the head of the lever pin to retain the torsion spring other end in the slot of the housing.

11. A glove box latch according to claim 10 wherein the lever includes a lateral opening for receiving the torsion spring one end.

12. A glove box latch according to claim 11 wherein an outer collar is integrally molded to the housing and extends rearwardly from the housing, and wherein the locking collar is mounted in the outer collar.

13. A glove box latch according to claim 12 wherein at least one undercut is provided on the button in register with the finger of the lever to interlock the lever to the button.

14. A glove box latch according to claim 13 wherein two undercuts are provided on opposite sides of the button.

15. A glove box latch according to claim 14 wherein the button is integrally molded to form the undercuts.

* * * * *